US011214480B2

(12) United States Patent
Johnson et al.

(10) Patent No.: US 11,214,480 B2
(45) Date of Patent: Jan. 4, 2022

(54) APPARATUS, SYSTEM, AND METHOD FOR FILLING A CHAMBERED PACKAGE

(71) Applicant: Church & Dwight Co., Inc., Princeton, NJ (US)

(72) Inventors: Thomas Johnson, Hightstown, NJ (US); Carl Henry, Newtown, PA (US); Jonathan Wharton, Ewing, NJ (US); Eddie A. Roman, Wrightstown, NJ (US)

(73) Assignee: Church & Dwight Co., Inc., Princeton, NJ (US)

( * ) Notice: Subject to any disclaimer, the term of this patent is extended or adjusted under 35 U.S.C. 154(b) by 44 days.

(21) Appl. No.: 16/388,313

(22) Filed: Apr. 18, 2019

(65) Prior Publication Data

US 2019/0322520 A1 Oct. 24, 2019

Related U.S. Application Data

(60) Provisional application No. 62/660,009, filed on Apr. 19, 2018.

(51) Int. Cl.

| | |
|---|---|
| ***B67D 7/42*** | (2010.01) |
| ***B65B 39/00*** | (2006.01) |
| ***B65B 43/60*** | (2006.01) |

(52) U.S. Cl.

CPC ..... *B67D 7/428* (2013.01); *B65B 39/00* (2013.01); *B65B 43/60* (2013.01)

(58) Field of Classification Search

CPC ..... B67D 7/428; B67D 7/42; B65B 39/00; B65B 43/60; B65B 3/24; B65B 3/36;

(Continued)

(56) References Cited

U.S. PATENT DOCUMENTS 1,524,915 A * 2/1925 Debay ..... B28B 5/10 425/220
2,546,059 A * 3/1951 Cloud ..... B65B 9/04 53/453

(Continued)

FOREIGN PATENT DOCUMENTS

| | | |
|---|---|---|
| CA | 1299940 | 5/1992 |
| WO | 2000053496 | 9/2000 |
| WO | WO 2015/179584 | 11/2015 |

OTHER PUBLICATIONS

Merriam-Webster, "Housing" [Retrieved on Apr. 14, 2021. Retrieved from the Internet URL: https://www.merriam-webster.com/dictionary/housing] (Year: 2021).*

(Continued)

*Primary Examiner* — Timothy P. Kelly
*Assistant Examiner* — Stephanie A Shrieves
(74) *Attorney, Agent, or Firm* — Church & Dwight Co., Inc.

(57) ABSTRACT

An apparatus for filling a chambered package can include a dispensing nozzle angled relative to a perpendicular of a machine direction of a carrying mechanism, the dispensing nozzle being disposed adjacent to the carrying mechanism having one or more chambered recess defined about a surface thereof, the dispensing nozzle being configured to dispense a quantity of the medium into the one or more chambered recess defined about the surface of the carrying mechanism. The apparatus includes a housing and at least one wiping material arranged to define an angle having a vertex toward the machine direction about a bottom surface of the housing, the angle of the at least one wiping material being configured to direct any of the quantity of the medium dispensed out of the second end of the dispensing nozzle, but (Continued)

not directed into the one or more chambered recess, into the one or more chambered recess.

20 Claims, 9 Drawing Sheets

(58) Field of Classification Search
CPC ..... A47L 15/44; B67C 3/02; B67C 3/023; B67C 3/208
USPC ..... 141/100, 125
See application file for complete search history.

(56) References Cited

U.S. PATENT DOCUMENTS 3,057,127 A 10/1962 Gex et al.
3,218,776 A * 11/1965 Cloud ..... B65B 47/10 53/453
3,570,557 A * 3/1971 Molins ..... A24D 3/0225 141/99
4,094,344 A * 6/1978 Hasegawa ..... B27G 1/00 118/669
4,375,146 A * 3/1983 Chung ..... B65B 9/042 53/453
4,425,107 A * 1/1984 Hall ..... A24D 3/0225 222/218
4,437,294 A * 3/1984 Romagnoli ..... B65B 1/366 53/553
4,509,568 A * 4/1985 Kawaguchi ..... B65B 1/00 141/129
4,571,924 A 2/1986 Bahrani
4,962,166 A 10/1990 Boinot et al.
5,187,921 A 2/1993 Wilson et al.
6,726,791 B1 * 4/2004 Øelund ..... A61F 13/0226 156/199
6,837,281 B2 * 1/2005 Spiers ..... B65B 1/366 141/125
7,661,248 B2 * 2/2010 Conti ..... B65B 29/025 53/529
8,590,582 B2 * 11/2013 Jackels ..... B65G 29/00 141/81
8,662,880 B2 * 3/2014 Fowler ..... B65B 3/04 425/388
9,162,413 B2 10/2015 Hartman et al.
9,340,363 B2 5/2016 Jackels et al.
2007/0084520 A1 * 4/2007 Driessen ..... B01F 15/0445 141/2
2011/0016834 A1 * 1/2011 Rapparini ..... B65B 9/042 53/510
2012/0235329 A1 9/2012 Fowler et al.
2014/0228194 A1 8/2014 Kepinski et al.
2016/0068285 A1 3/2016 Fowler et al.
2016/0347521 A1 12/2016 Fowler et al.
2017/0101203 A1 4/2017 Waterman et al.
2017/0101204 A1 4/2017 Waterman et al.

OTHER PUBLICATIONS

Office Action dated Jul. 27, 2021, in corresponding Chinese patent application No. 201980026712.1.

* cited by examiner

APPARATUS, SYSTEM, AND METHOD FOR FILLING A CHAMBERED PACKAGE

FIELD OF THE DISCLOSURE

The present disclosure relates to an apparatus, system, and method for filling a chambered package. More particularly, the present disclosure relates to an apparatus, system, and method for automatically filling a chambered package for use in laundry and dishwashing applications.

BACKGROUND

Various types of chambered packages (e.g., unit dose packs, pods, cavity tablets, etc.) have been used for many years in the area of household care to provide a single-use, pre-dosed quantity of detergent in laundry and dishwashing applications. These types of chambered packages are generally formed from webs of film material that are in some way bonded together to form chambered recesses enclosing detergent provided within. In some of the chambered packages, different types of detergents are provided in different chambered recesses within the package to provide various cleaning effects throughout the laundry and/or dishwashing application. For example, a two chambered package may include detergent broken up into two different components: a powder component in one chambered recess and another powder, or a liquid or gel component in a second chambered recess, where only during the laundry or dishwashing application do the two components intermix. In another example, a single chambered package may include a powder detergent disposed within a single chambered recess.

Since the webs of film material are bonded together, it is desirable to ensure that the detergent be directed into the chambered recesses formed by the webs of film material so as to not interfere with the bonding therebetween. Current techniques employed to ensure that detergents, such as powdered detergents, are directed into the chambered recesses include, for example, vacuum systems configured to remove excess detergent, wiper assemblies configured to direct excess detergent into the chambered recesses, custom dispensing nozzles configured to dispense the powdered detergent into the chambered recesses, etc. However, these current techniques tend to be problematic. For example, current vacuum systems require a detailed maintenance schedule and often result in higher levels of product scrap, higher operating costs. In another example, current wiper assemblies may be unable to precisely direct the detergent into the chambered recesses which often results in increased product scrap. In addition, a complexity of current wiper assemblies often results in increased frequency of maintenance. In a still further example, custom dispensing nozzles generally require a long lead time for design and production purposes, and any design changes necessarily require additional costs, which then limit design flexibility and operational ranges.

Accordingly, there remains a need for an improved apparatus, system, and method for filling chambered packages that addresses at least some of the issues described above.

SUMMARY OF THE DISCLOSURE

The present disclosure relates to apparatuses, systems, and methods for filling chambered packages. In some aspects, an apparatus for filling a chambered package may comprise a dispensing nozzle defining a longitudinal opening extending from a first end to a second end, the first end of the dispensing nozzle receiving a medium and the second end of the dispensing nozzle being angled relative to a perpendicular of a machine direction of a carrying mechanism, the second end of the dispensing nozzle being disposed adjacent to the carrying mechanism traveling in the machine direction and having one or more chambered recess defined about a surface of the carrying mechanism, the dispensing nozzle being configured to dispense a quantity of the medium received from the first end through the longitudinal opening and out of the second end into the one or more chambered recess defined about the surface of the carrying mechanism; a housing attachable to the dispensing nozzle about the second end, the housing defining a bottom surface extending away from the dispensing nozzle and adjacent to the carrying mechanism; and at least one wiping material that is arranged to define an angle having a vertex toward the machine direction about the bottom surface of the housing, the angle of the at least one wiping material being configured to direct any of the quantity of the medium dispensed out of the second end of the dispensing nozzle, but not directed into the one or more chambered recess, into the one or more chambered recess.

The second end of the dispensing nozzle and the bottom surface of the housing may each be contoured to match a contour of the surface of the carrying mechanism.

The carrying mechanism may comprise a rotating drum having a cylindrical surface or the carrying mechanism can comprise a flatbed conveyor having a planar surface.

The second end of the dispensing nozzle may be disposed between about 10 degrees and about 95 degrees relative to a center of the rotating drum.

The second end of the dispensing nozzle may be angled between about 20 degrees and about 80 degrees relative to the perpendicular of the machine direction of the carrying mechanism.

The at least one wiping material may be arranged to define the angle having the vertex toward the machine direction about the bottom surface of the housing between about 15 degrees and about 45 degrees.

There may be three concentrically arranged wiping materials each defining an angle having a vertex toward the machine direction about the bottom surface of the housing, each angle being about 30 degrees.

The apparatus may further comprise a tongue extending opposite to the housing and from the second end of the dispensing nozzle, the tongue being contoured to match a contour of the surface of the carrying mechanism.

The second end of the dispensing nozzle may comprise a resilient material configured to directly interact with the carrying mechanism in order to direct the quantity of the medium into the one or more chambered recess defined about the surface of the carrying mechanism.

In some aspects, a system for filling a chambered package may comprise a carrying mechanism travelling in a machine direction and having one or more chambered recess defined about a surface thereof; and a dispensing apparatus comprising: a dispensing nozzle defining a longitudinal opening extending from a first end to a second end, the first end of the dispensing nozzle receiving a medium and the second end of the dispensing nozzle being angled relative to a perpendicular of the machine direction, the second end of the dispensing nozzle being disposed adjacent to the carrying mechanism, the dispensing nozzle being configured to dispense a quantity of the medium received from the first end through the longitudinal opening and out of the second end into the one or more chambered recess defined about the surface of the carrying mechanism; a housing attachable to the dispensing nozzle about the second end, the housing defining a bottom surface extending away from the dispensing nozzle and adjacent to the carrying mechanism; and at least one wiping material that is arranged to define an angle having a vertex toward the machine direction about the bottom surface of the housing, the angle of the at least one wiping material being configured to direct any of the quantity of the medium dispensed out of the second end of the dispensing nozzle, but not directed into the one or more chambered recess, into the one or more chambered recess.

The second end of the dispensing nozzle and the bottom surface of the housing may each be contoured to match a contour of the surface of the carrying mechanism.

The carrying mechanism may comprise a rotating drum having a cylindrical surface or the carrying mechanism comprises a flatbed conveyor having a planar surface.

The second end of the dispensing nozzle may be disposed between about 10 degrees and about 95 degrees relative to a center of the rotating drum.

The second end of the dispensing nozzle may be angled between about 20 degrees and about 80 degrees relative to the perpendicular of the machine direction of the carrying mechanism.

The at least one wiping material may be arranged to define the angle having the vertex toward the machine direction about the bottom surface of the housing between about 15 degrees and about 45 degrees.

There may be three concentrically arranged wiping materials each defining an angle having a vertex toward the machine direction about the bottom surface of the housing, each angle being about 30 degrees.

The system may further comprise a tongue extending opposite to the housing and from the second end of the dispensing nozzle, the tongue being contoured to match a contour of the surface of the carrying mechanism.

The second end of the dispensing nozzle may comprise a resilient material configured to directly interact with the carrying mechanism in order to direct the quantity of the medium into the one or more chambered recess defined about the surface of the carrying mechanism.

The system may further comprise a controller configured to control the dispensing apparatus to dispense the quantity of the medium into the one or more chambered recess defined about the surface of the carrying mechanism when the one or more chambered recess is substantially aligned with the second end of the dispensing nozzle.

In some aspects, a method for filling a chambered package may comprise dispensing a quantity of a medium from a dispensing nozzle and into one or more chambered recess defined about a surface of a carrying mechanism traveling in a machine direction, the dispensing nozzle defining a longitudinal opening extending from a first end to a second end, the first end of the dispensing nozzle receiving the medium and the second end of the dispensing nozzle being angled relative to a perpendicular of the machine direction, the second end of the dispensing nozzle being disposed adjacent to the carrying mechanism, the dispensing nozzle being configured to dispense the quantity of the medium received from the first end through the longitudinal opening and out of the second end into the one or more chambered recess; and directing, by at least one wiping material that is arranged to define an angle having a vertex toward the machine direction about a bottom surface of a housing attachable to the dispensing nozzle about the second end thereof, any of the quantity of the medium dispensed out of the second end of the dispensing nozzle, but not directed into the one or more chambered recess, into the one or more chambered recess, the bottom surface of the housing extending away from the dispensing nozzle and adjacent to the carrying mechanism.

The method may further comprise providing the dispensing nozzle and the housing, the bottom surface of the housing and the second end of the dispensing nozzle each being contoured to match a contour of the surface of the carrying mechanism.

The method may further comprise providing the carrying mechanism, which comprises a rotating drum having a cylindrical surface or a flatbed conveyor having a planar surface.

The method may further comprise disposing the second end of the dispensing nozzle between about 10 degrees and about 95 degrees relative to a center of the rotating drum.

The method may further comprise providing the dispensing nozzle, the second end of the dispensing nozzle being angled between about 20 degrees and about 80 degrees relative to the perpendicular of the machine direction of the carrying mechanism.

The method may further comprise arranging the at least one wiping material to define the angle having the vertex toward the machine direction about the bottom surface of the housing between about 15 degrees and about 45 degrees.

Arranging the at least one wiping material may comprise arranging three wiping materials concentrically about the bottom surface of the housing, each of the wiping materials defining an angle having a vertex toward the machine direction about the bottom surface of the housing, each angle being about 30 degrees.

The method may further comprise providing a tongue extending opposite to the housing and from the second end of the dispensing nozzle, the tongue being contoured to match a contour of the surface of the carrying mechanism.

Dispensing the quantity of the medium from the dispensing nozzle may comprise providing the second end of the dispensing nozzle with a resilient material such that the second end of the dispensing nozzle directly interacts with the carrying mechanism in order to direct the quantity of the medium into the one or more chambered recess defined about the surface of the carrying mechanism.

The method may further comprise controlling the dispensing apparatus to dispense the quantity of the medium into the one or more chambered recess defined about the surface of the carrying mechanism when the one or more chambered recess is substantially aligned with the second end of the dispensing nozzle.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DISCLOSURE

The present disclosure now will be described more fully hereinafter with reference to specific embodiments and particularly to the various drawings provided herewith. Indeed, the disclosure may be embodied in many different forms and should not be construed as limited to the embodiments set forth herein; rather, these embodiments are provided so that this disclosure will satisfy applicable legal requirements. As used in the specification, and in the appended claims, the singular forms "a," "an," "the," include plural referents unless the context clearly dictates otherwise.

The present disclosure relates to an apparatus, system, and method for filling a chambered package. The apparatus, system, and method are utilized for directing a medium into one or more chambered recess defined about a surface of a carrying mechanism. Notably, the chambered recess defined about the surface of the carrying mechanism forms a chamber of a chambered package suitable for use in laundry and dishwashing applications. For example, the chambered package is introduced into a detergent cavity in a washing machine or a dishwasher. The chambered package is also usable in similar applications.

Figure 1:
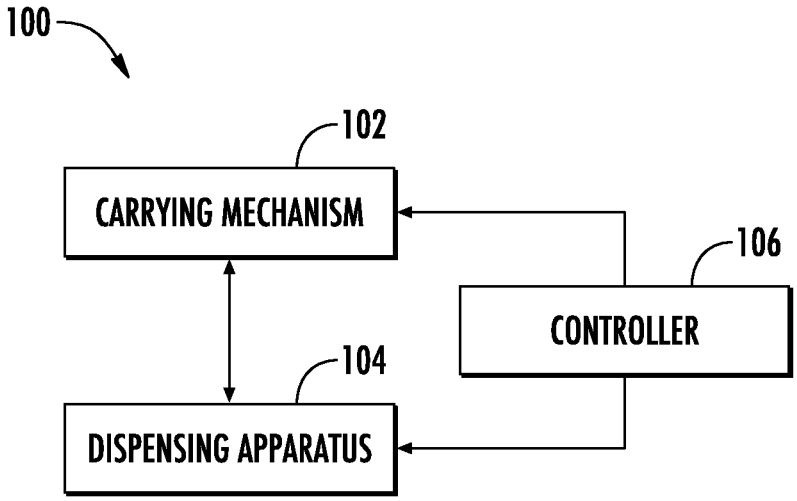
FIG. 1 illustrates a system for filling a chambered package according to various aspects of the present disclosure.

FIG. 1 illustrates a system diagram 100 of an exemplary system for filling a chambered package. The exemplary system includes a carrying mechanism 102 and a dispensing apparatus 104. Other elements of the system may comprise a controller 106.

The carrying mechanism 102 generally refers to a device travelling in a machine direction that is configured to convey a medium in said direction. For example, the carrying mechanism may comprise a rotating drum rotating about a rotational axis and having a cylindrical surface disposed between two opposing end faces. In another example, the carrying mechanism may comprise a flatbed conveyor having a planar surface. Other example embodiments of carrying mechanisms are also contemplated.

Figure 2A:
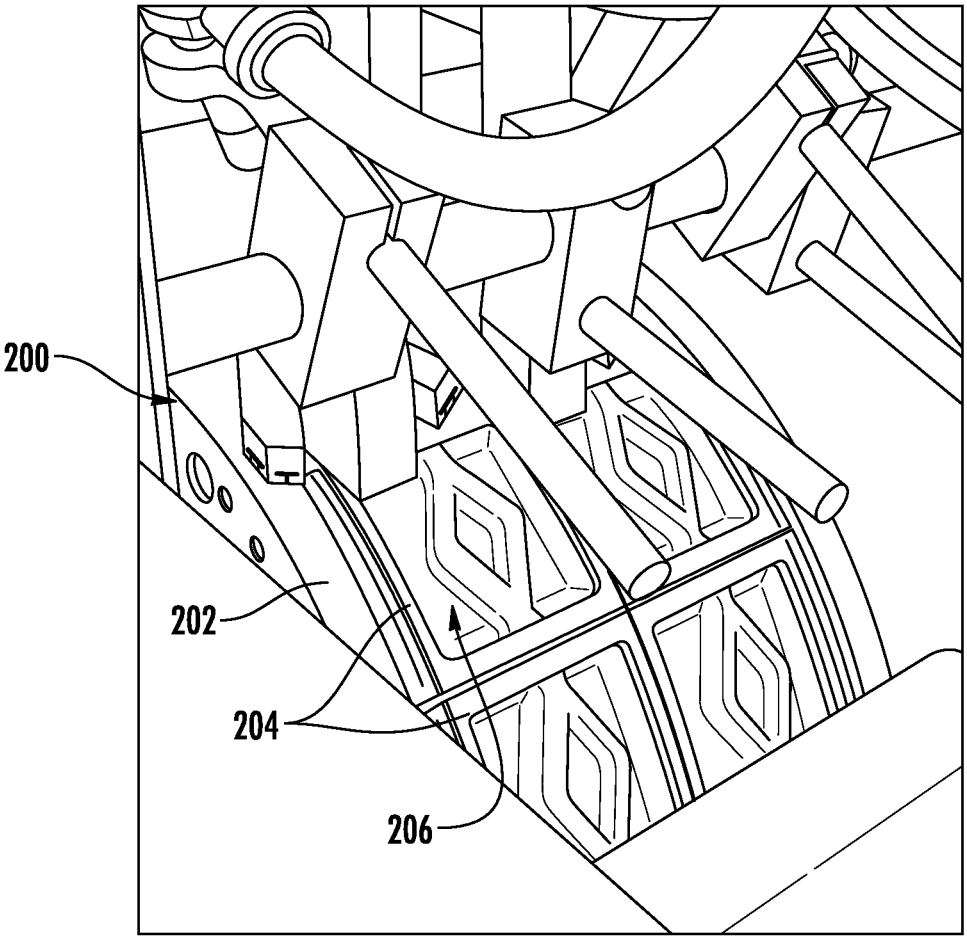
FIG. 2A illustrates an exemplary system for filling a chambered package, where a carrying mechanism is a rotating drum according to various aspects of the present disclosure.

Regardless of the type of carrying mechanism described herein, one or more chambered recess is defined about a surface thereof. Referring to FIG. 2A, for example, one exemplary embodiment of a carrying mechanism, such as a rotating drum 200 is illustrated. The rotating drum defines a cylindrical surface 202, which may further comprise one or more platen 204 attached thereto. A contour of the platen may match a contour of the cylindrical surface of the rotating drum so that each of the one or more platen is securely attachable to the rotating drum. One or more chambered recess 206 is defined about the surface of the carrying mechanism (rotating drum). More particularly, each of the one or more contoured platens may define a chambered recess or the surface of the carrying mechanism, itself, may define one or more chambered recess. As illustrated in FIG. 2A, the cylindrical surface extends in a cross-machine direction from a first end face of the rotating drum to a second end face of the rotating drum and defines two rows of platens, each platen defining a chambered recess therein.

Figure 2B:
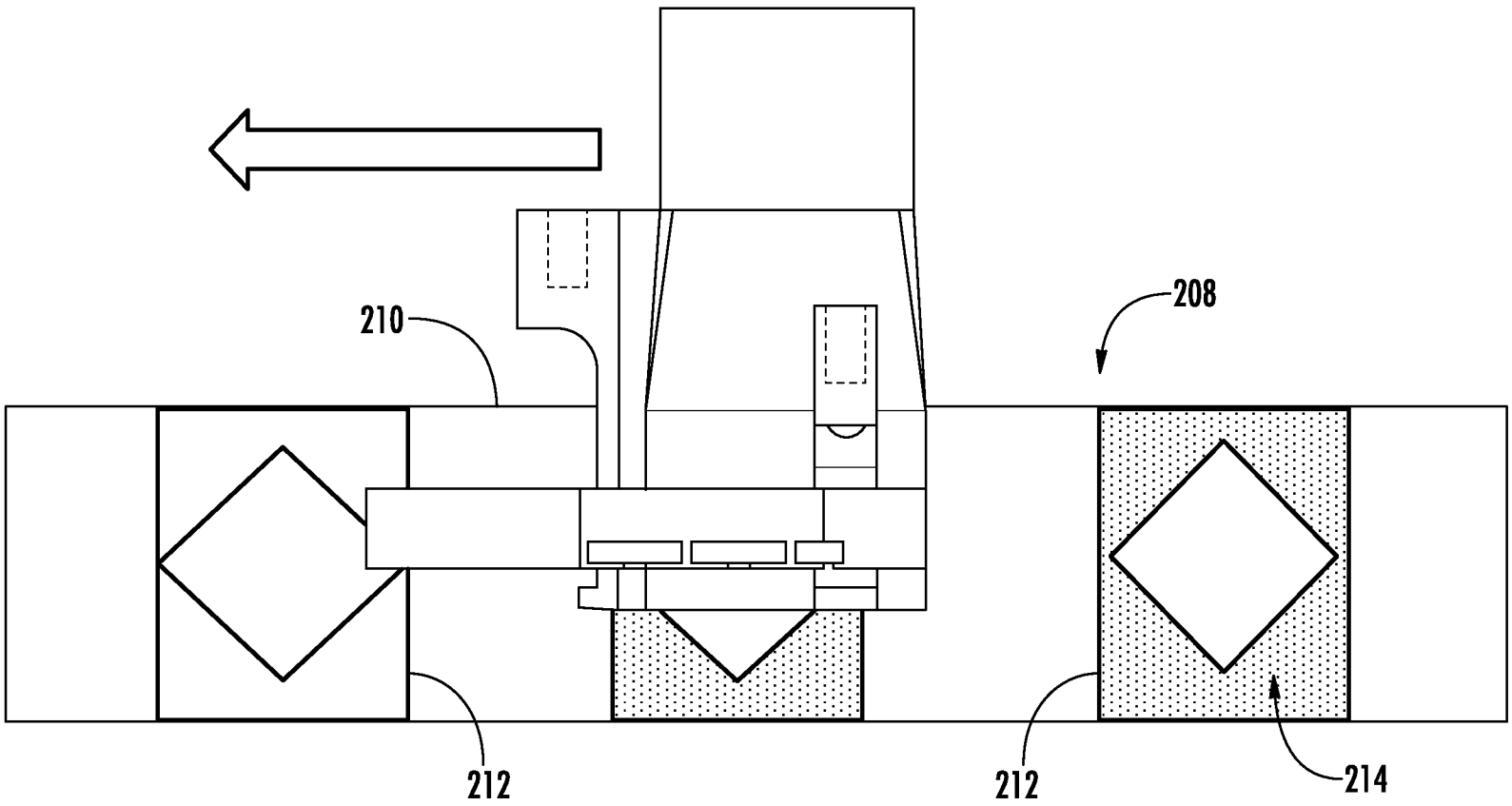
FIG. 2B illustrates an exemplary system for filling a chambered package, where a carrying mechanism is a flatbed conveyor according to various aspects of the present disclosure.
Figure 3A:
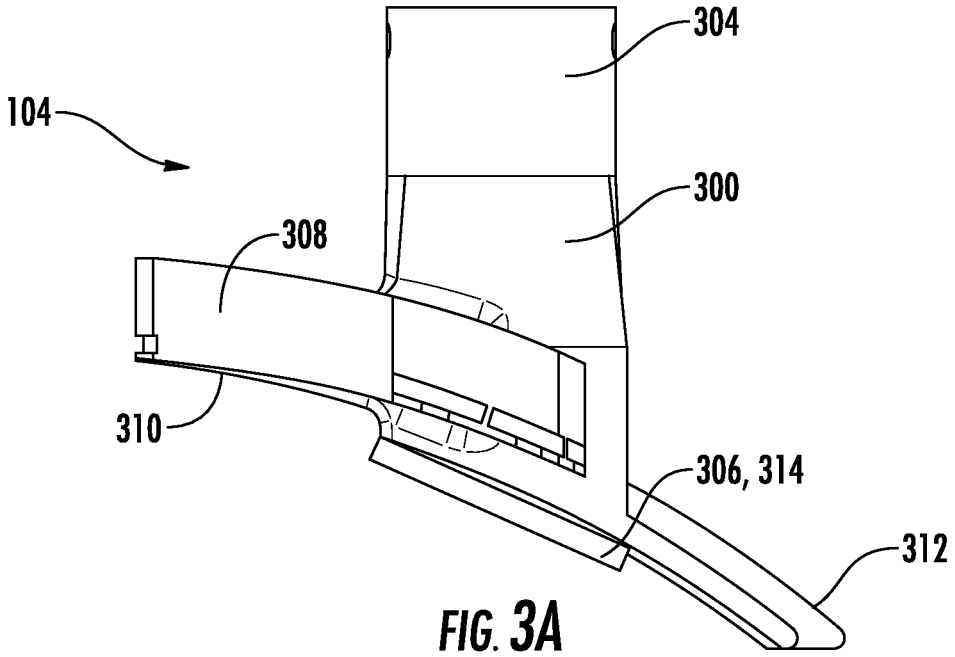
FIGS. 3A-3D illustrate views of an exemplary apparatus for filling a chambered package according to various aspects of the present disclosure.
Figure 3B:
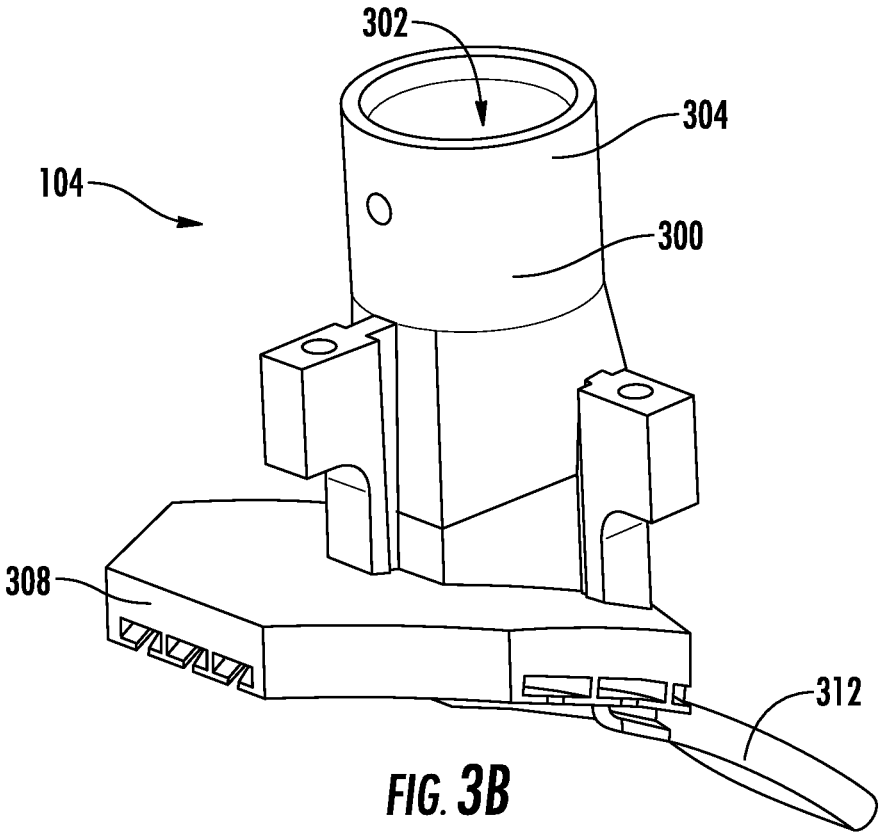
Figure 3C:
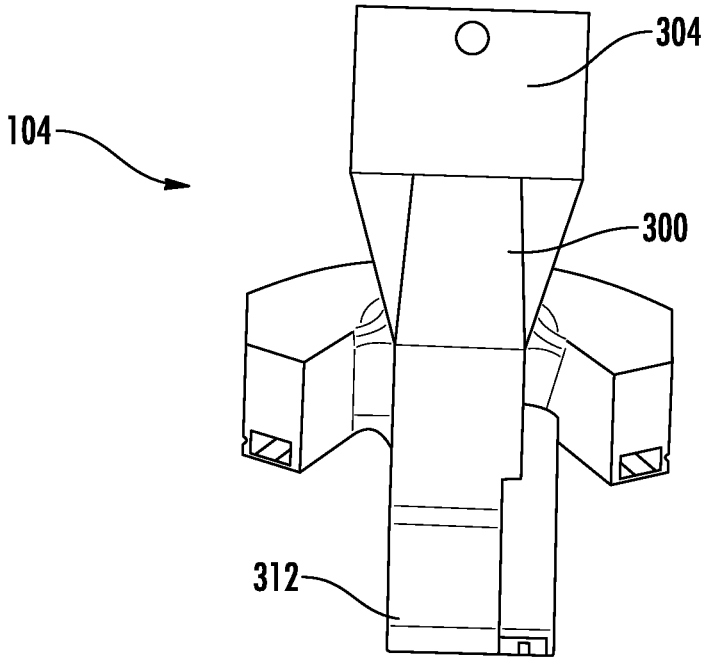
Figure 3D:
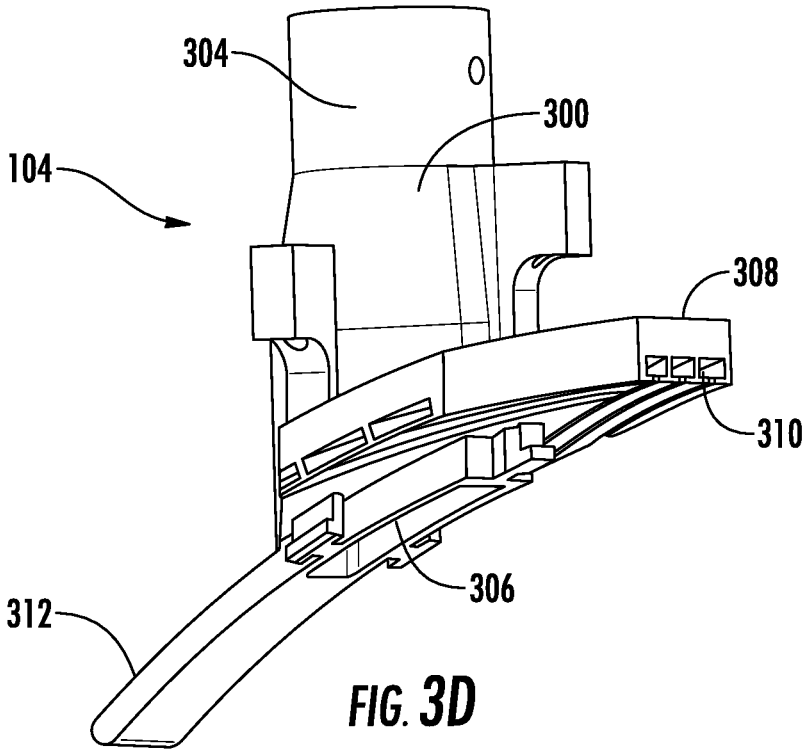
Figure 3E:
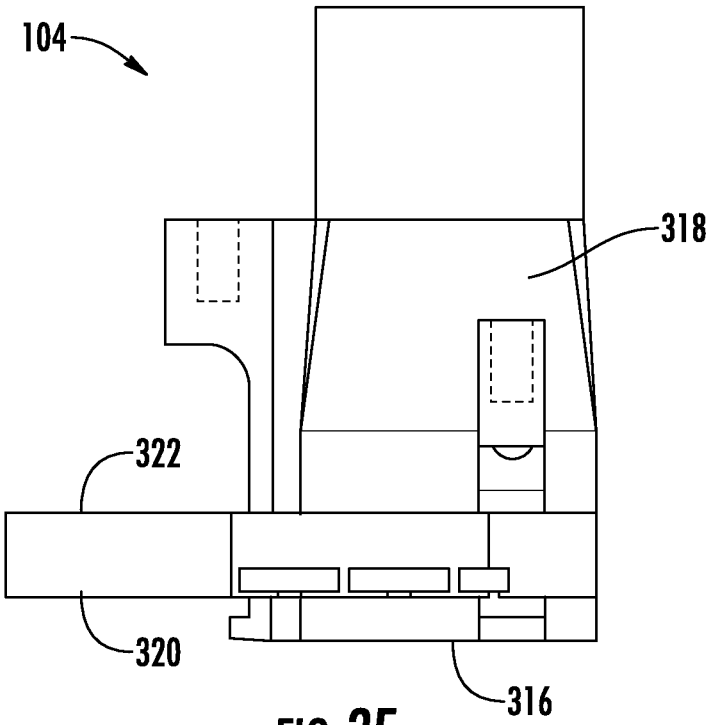
FIGS. 3E-3H illustrate views of another exemplary apparatus for filling a chambered package according to various aspects of the present disclosure.
Figure 3F:
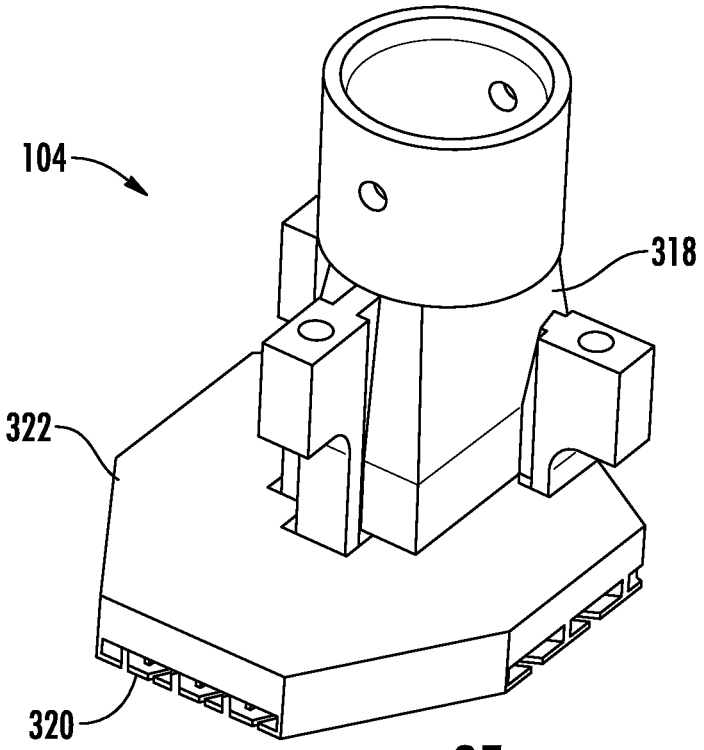
Figure 3G:
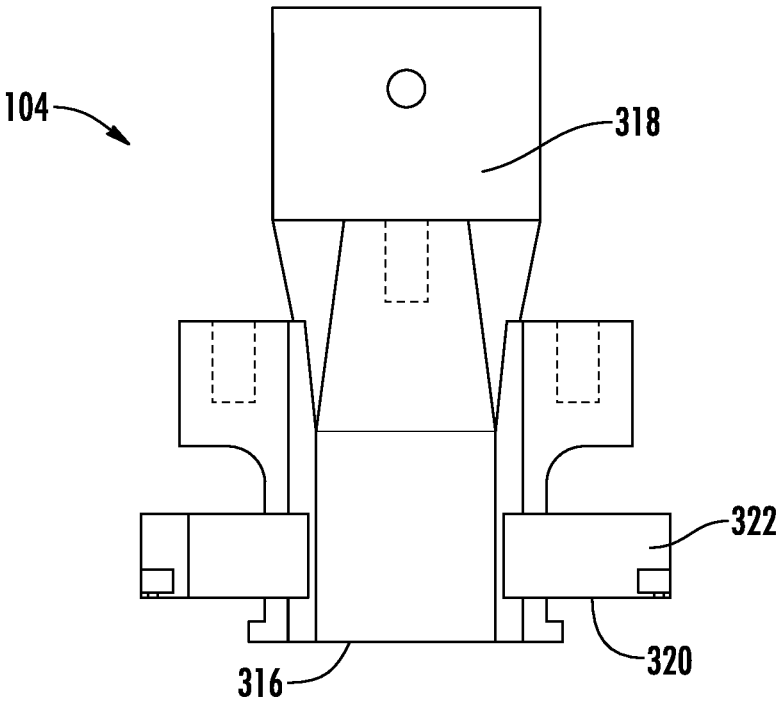
Figure 3H:
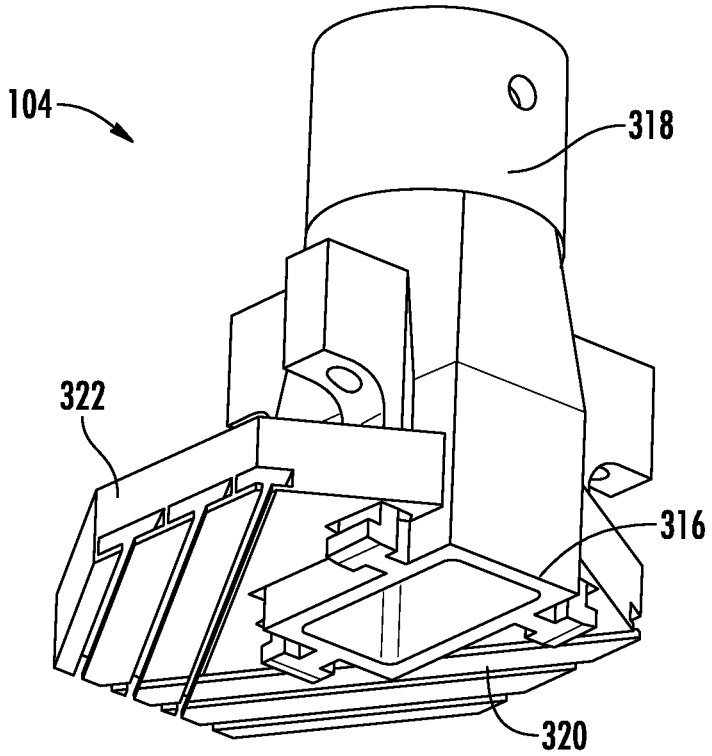

Referring to FIG. 2B, for example, another exemplary embodiment of a carrying mechanism, such as a flatbed conveyor 208 is illustrated. The flatbed conveyor defines a planar surface 210, which may further comprise one or more platen 212 attached thereto. A contour of the platen may match a contour of the planar surface of the flatbed conveyor so that each of the one or more platen is securely attachable to the flatbed conveyor. One or more chambered recess 214 may be defined about the surface of the carrying mechanism (flatbed conveyor). As illustrated in FIG. 2B, the planar surface extends in a cross-machine direction and defines a single row of platens, each platen defining a chambered recess therein. However, the carrying mechanism may define any mechanism configured to travel in a machine direction to convey a medium in said direction.

In some example aspects, the carrying mechanism 102 may be configured to accommodate a web of film material that extends about a surface of the carrying mechanism and is received within the one or more chambered recesses 206. The web of film material may comprise a flexible, water soluble film material, such as a sheet-like flexible plastic formed of, for example, cellophane, polyethylene, acetates, polyvinyl alcohol (PVA), or the like, that is capable of having individual chambers formed therein, of being sealed and folded, bonded etc. In some aspects, a forming arrangement (e.g., a vacuum) is configured to interact with the web of film material. More particularly, for example, the forming arrangement is configured to exert a negative pressure through each of the one or more platen 204 or through the surface of the carrying mechanism so as to draw the web of film material into the one or more chambered recesses. As such, the carrying mechanism provides one or more chambered recess having a web of film material drawn into a bottom thereof, in which a quantity of medium may be dispensed.

Returning back to FIG. 1, the dispensing apparatus 104 may be configured to dispense a quantity of a medium into one or more of the chambered recess defined about the surface of the carrying mechanism 102. Whether the carrying mechanism is a rotating drum (e.g., FIG. 2A), a flatbed conveyor (e.g., FIG. 2B), or any other similar carrying mechanism, the dispensing apparatus is configured to dispense a pre-determined quantity of the medium into the one or more chambered recess. The medium deposited into the chambered recess may be, for example, in the form of a powder, a liquid, a gel, a plurality of microbeads, or a combination thereof. In turn, the medium may further comprise, for example, surfactants, bleaching agents, enzymes, bleach activators, corrosion inhibitors, scale inhibitors, cobuilders, dyes and/or perfumes, bicarbonates, soil release polymers, optical brighteners, dye transfer or redeposition inhibitors, defoamers, and/or mixtures thereof.

FIGS. 3A-3D illustrate various views of one exemplary embodiment of the dispensing apparatus 104, illustrated in FIG. 1. In this exemplary embodiment, the dispensing apparatus is configured to be used with a carrying mechanism in the form of a rotatable drum, or some other curved carrying mechanism. The dispensing apparatus illustrated in FIGS. 3A-3D thus comprises a dispensing nozzle 300 defining a longitudinal opening 302 extending from a first end 304 to a second end 306. The first end of the dispensing nozzle is configured to receive a medium (e.g., a powder). In some aspects, the first end of the dispensing nozzle is in communication with a hopper or other feed mechanism that feeds the first end of the dispensing nozzle the medium. A valve (not shown) or other control mechanism (e.g., controller 106) may be configured to control a flow of the medium received by the first end of the dispensing nozzle such that the quantity of the medium received from the first end and through the longitudinal opening is metered out based on one or more factors, such as characteristic of the material, a diameter of the nozzle, a length of the longitudinal opening, a travel speed of the carrying mechanism, a size of the one or more recess, and the like.

The second end 306 of the dispensing nozzle 300 is configured to dispense the quantity of the medium received from the first end 304 through the longitudinal opening 302 and out of the second end into the one or more chambered recess defined about a surface of a carrying mechanism. In some example implementations, the second end of the dispensing nozzle is fixedly attached to the longitudinal opening, while in other example implementations; the second end of the dispensing nozzle is movably attached to the longitudinal opening. FIGS. 3A-3D illustrate a fixedly attached arrangement, although movable arrangements such as a pivoting second end, a sliding second end, a spring-loaded second end, and the like are also contemplated herein.

The second end 306 of the dispensing nozzle 300 is also angled relative to a perpendicular of a machine direction of a carrying mechanism. More particularly, the second end of the dispensing nozzle may be angled between about 20 degrees and about 80 degrees relative to the perpendicular of the machine direction of the carrying mechanism; preferably between about 40 degrees and about 70 degrees; and most preferably about 60 degrees relative to the perpendicular of the machine direction. In this manner, the second end of the dispensing nozzle being angled about 60 degrees relative to the perpendicular is considered most advantageous in effectively directing a medium into a chambered recess defined about a surface of a carrying medium traveling in a machine direction.

Figure 4:
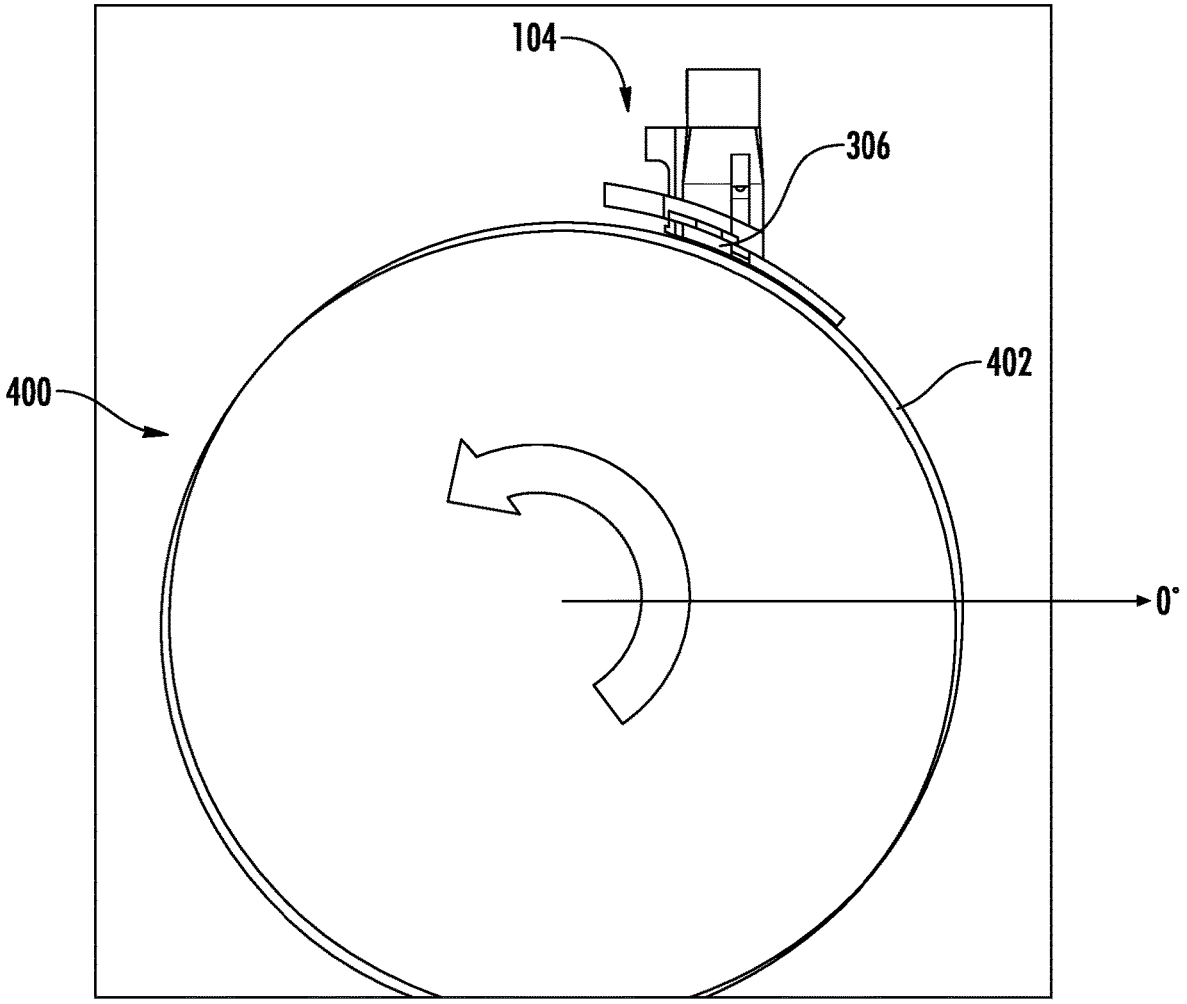
FIG. 4 illustrates an exemplary view of a dispensing nozzle provided adjacent to a rotating drum according to various aspects of the present disclosure.

In some example implementations, the second end 306 of the dispensing nozzle 300 is disposed adjacent to a carrying mechanism traveling in the machine direction. FIG. 4 illustrates a carrying mechanism such as a rotating drum 400 where the second end of the dispensing nozzle of FIGS. 3A-3D is disposed adjacent thereto. As used herein, "disposed adjacent" means in close proximity to (not in direct contact with) or in direct contact with, such that the second end of the dispensing nozzle of FIGS. 3A-3D is in close proximity to or in direct contact with a cylindrical surface 402 of the carrying mechanism.

Further, where the carrying mechanism is a rotating drum, such as the rotating drum 400, the second end 306 of the dispensing nozzle 300 may be disposed adjacent to the rotating drum between about 10 degrees and about 95 degrees relative to a center (i.e., a horizontal axis bisecting a center point) of the rotating drum. More particularly, FIG. 4 illustrates the second end of the dispensing nozzle located at about 75 degrees relative to the center of the rotating drum. In this manner, the second end of the dispensing nozzle is configured to dispense the quantity of the medium into the one or more chambered recess prior to gravitational inertia counteracting the centripetal force of the rotating drum.

While not illustrated in FIG. 4, the cylindrical surface of the carrying mechanism may have one or more chambered recess defined about the surface thereof, such that the second end of the dispensing nozzle is disposed adjacent to the one or more chambered recess as well. In this manner, as the carrying mechanism travels in the machine direction, the dispensing nozzle may remain stationary with regard to the machine direction, and may maintain direct contact with or close proximity to the surface and/or the one or more chambered recesses along the surface of the carrying mechanism.

Referring back to FIGS. 3A-3D, the dispensing apparatus 104 further comprises a housing 308 attachable to the dispensing nozzle 300 about the second end 306. The housing defines a bottom surface 310 (e.g., FIG. 5A) extending away from the dispensing nozzle and adjacent to the carrying mechanism. The housing may be formed integrally with the dispensing nozzle or may be formed as removably attachable to the dispensing nozzle. For example, the housing may be formed as a separate component from the dispensing nozzle, such that the dispensing apparatus is formed as a "multi-piece" dispensing apparatus (e.g., a floating system) to allow for at least two degrees of freedom of movement of the housing relative to the dispensing nozzle during fill of the chambered package. In this manner, the housing may moveably compress against the dispensing nozzle during fill of the chambered package, which may inhibit binding effects or the dispensing nozzle immovably binding against the housing during use. Guide rails with end stops, a hinge, springs, and the like may be used for connecting the housing to the dispensing nozzle to allow for such freedom of movement between the two components. Otherwise, the housing may be fixed to the dispensing nozzle so that there is no compressive movement between the two components during fill of the chambered package.

Figure 5A:
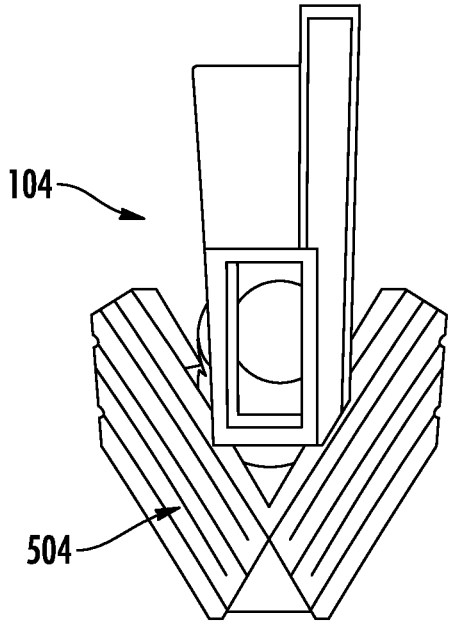
FIGS. 5A-5C illustrate views of an exemplary apparatus for filling a chambered package according to various aspects of the present disclosure.
Figure 5B:
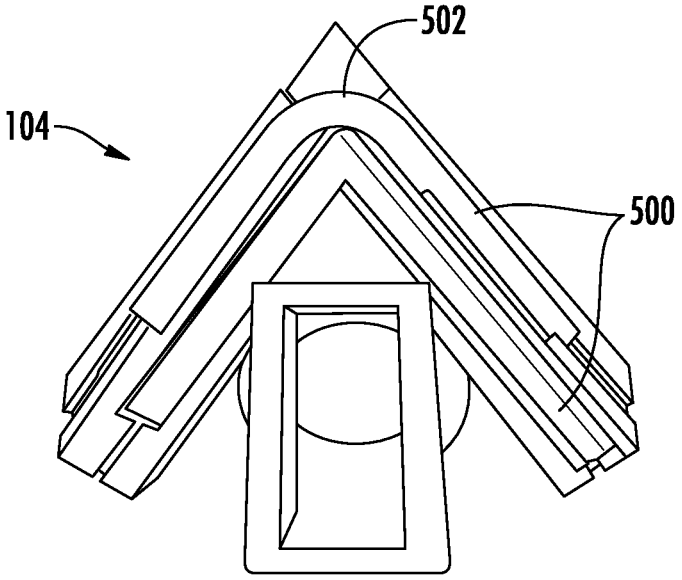
Figure 5C:
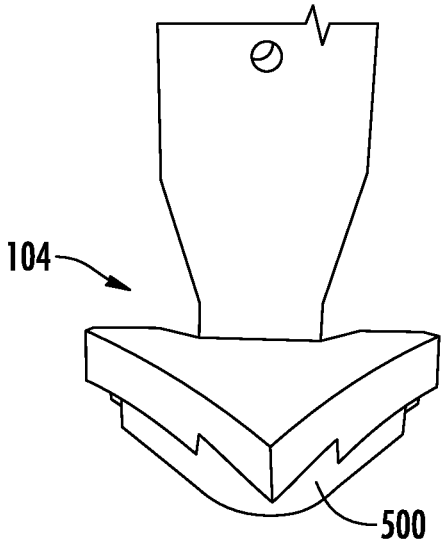

The dispensing apparatus 104 further comprises at least one wiping material. FIGS. 5A-5C illustrate an example implementation of at least one wiping material 500 that is arranged to define an angle having a vertex 502 toward a machine direction about a bottom surface of a housing. The bottom surface of the housing in FIGS. 5A-5C is substantially the same as or similar to the bottom surface 310 of the housing 308 illustrated in FIGS. 3A-3D. The at least one wiping material may be a compression molded carbon wiping material, such as ethylene propylene diene monomer (EPDM) rubber, which can be molded to the bottom surface of the housing of the dispensing apparatus.

As illustrated in FIG. 5A, at least one groove 504 sized to receive at least one wiping material therein, may be formed on the bottom surface of the housing. The at least one groove may be arranged to define an angle having a vertex toward a machine direction, such that when the at least one wiping material is arranged within the at least one groove, the at least one wiping material defines the angle having the vertex toward the machine direction. In some example implementations, the at least one wiping material is arranged to define the angle having the vertex toward the machine direction about the bottom surface of the housing between about 15 degrees and about 45 degrees. Preferably, the angle is about 30 degrees, although other angles are also contemplated. In some other example implementations, there may be more than one wiping material such as two, three, four, five, etc., concentrically arranged about the bottom surface of the housing. For example, there may be three concentrically arranged wiping materials each defining an angle having a vertex toward the machine direction about the bottom surface of the housing, each angle being about 30 degrees.

In another example implementation, rather than a single wiping material being arranged so as to define an angle having a vertex, at least two wiping materials may be convergingly arranged towards the machine direction. For example, two wiping materials may be arranged to form a 30 degree angle having a vertex toward the machine direction. In another example, there may be three concentrically arranged sets of two wiping materials, each set of two wiping materials defining an angle having a vertex toward the machine direction about the bottom surface of the housing, each angle being about 30 degrees.

Accordingly, the angle of the at least one wiping material 500 is configured to direct any of the quantity of the medium dispensed out of the second end 306 of the dispensing nozzle 300, but not directed into the one or more chambered recess, into the one or more chambered recess during travel of the carrying mechanism in the machine direction. More particularly, any of the quantity of the medium remaining on the surface of the carrying mechanism may be entrapped between the wiping material and the surface of the carrying mechanism and directed into the one or more chambered recess as the carrying mechanism travels in the machine direction.

Returning back to FIGS. 3A-3D, the dispensing apparatus 104 may further comprise a tongue 312 extending opposite to the housing 310 and from the second end 306 of the dispensing nozzle 300. The tongue may be formed integrally with the second end of the dispensing nozzle or may be formed as removably attachable with the second end of the dispensing nozzle in a manner similar to the housing. The tongue may be configured to ensure that any of the quantity of the medium dispensed out of the second end of the dispensing nozzle and into the one or more chambered recess is retained within the one or more chambered recess and is not moved into other recesses.

Furthermore, the second end 306 of the dispensing nozzle 300 may comprise a resilient material 314 configured to directly interact with the carrying mechanism in order to direct the quantity of the medium into the one or more chambered recess defined about the surface of the carrying mechanism. More particularly, the resilient material may include a same or similar material to the at least one wiping material 500, such as an EPDM rubber, such that the resilient material is configured to directly interact or touch the surface of the carrying material. Otherwise, the resilient material may include a material different than the at least one wiping material.

Advantageously, in order to direct the quantity of medium remaining on the surface, the second end 306 of the dispensing nozzle 300 and the bottom surface 310 of the housing 308, each adjacent to the surface of the carrying mechanism, may each be contoured to match a contour of the surface of the carrying mechanism. Likewise, the tongue 312 may be contoured to match a contour of the surface of the carrying mechanism. For example, where the carrying mechanism is a rotating drum, each of the second end of the dispensing nozzle, the bottom surface of the housing, and the tongue may comprise a curved contour that matches the cylindrical curvature of the contour of the cylindrical surface of the rotating drum.

FIGS. 3E-3H illustrate various views of another exemplary embodiment of the dispensing apparatus 104, illustrated in FIG. 1. In this exemplary embodiment, the dispensing apparatus is configured to be used with a carrying mechanism in the form of a flatbed conveyor, or some other planar carrying mechanism. The dispensing apparatus illustrated in FIGS. 3E-3H thus comprises elements similar to the exemplary embodiment illustrated in FIGS. 3A-3D. However, a second end 316 of a dispensing nozzle 318 and a bottom surface 320 of a housing 322, each adjacent to a surface of a carrying mechanism such as a flatbed conveyor, may each be planar to match the planar surface of the flatbed conveyor. Likewise, a tongue (not shown) may be planar to match the planar surface of the carrying mechanism. For example, where the carrying mechanism is a flatbed conveyor, each of the second end of the dispensing nozzle, the bottom surface of the housing, and the tongue may be planar to match the planar surface of the flatbed conveyor.

Returning back to FIG. 1, the system 100 includes the controller 106 configured to control the dispensing apparatus to dispense the quantity of the medium into the one or more chambered recess defined about the surface of the carrying mechanism when the one or more chambered recess is substantially aligned with the second end of the dispensing nozzle. The controller may be configured to also control the carrying mechanism. In this manner, the quantity of the medium may be dispensed during a predetermined fill-window, defined when the when the one or more chambered recess is substantially aligned with the second end of the dispensing nozzle, after a certain time period, as determined by sensors monitoring a distance of travel of the carrying mechanism, etc. The controller 106 may comprise a hardware processor and a memory.

Figure 6:
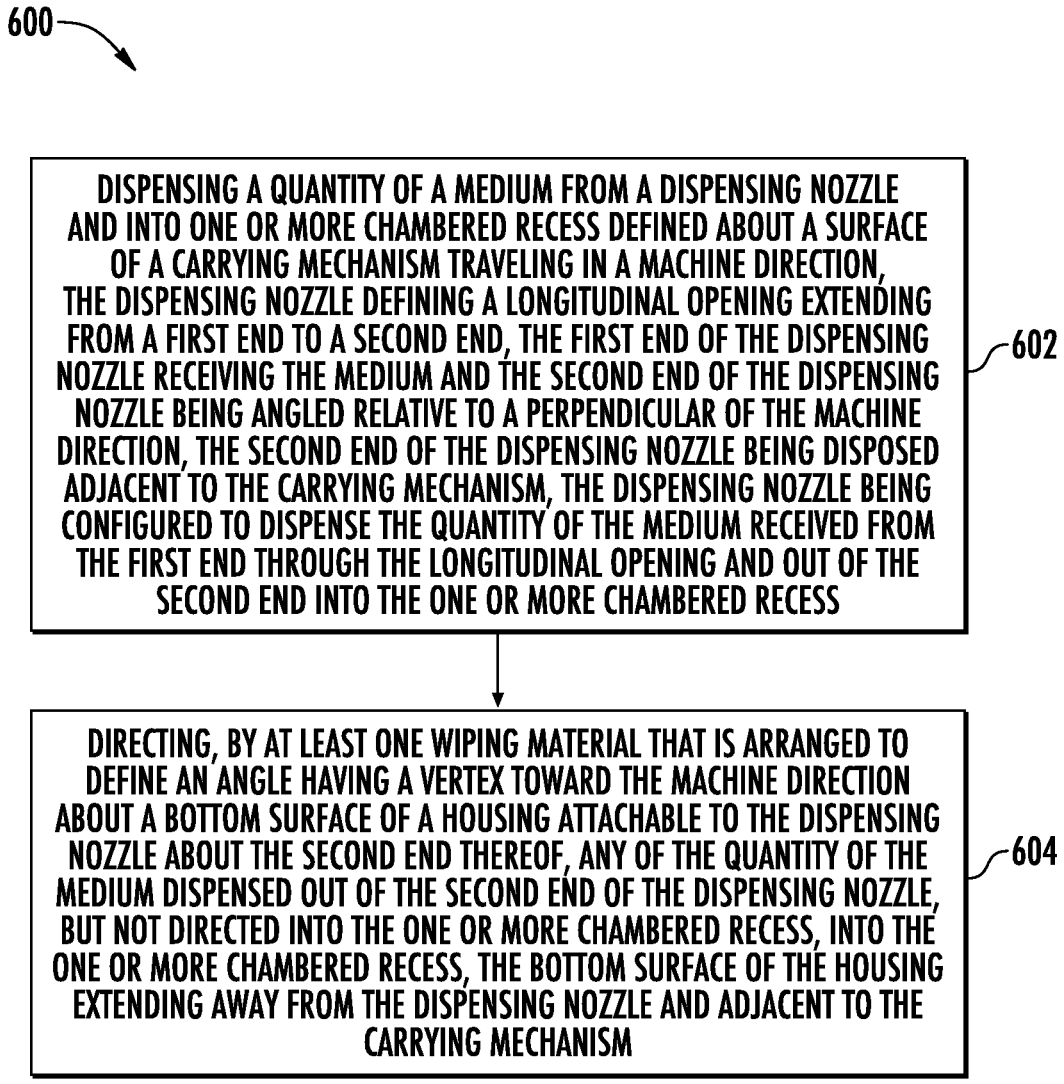
FIG. 6 illustrates a flow diagram of a method for filling a chambered package according to various aspects of the present disclosure.

FIG. 6 illustrates a method for filling a chambered package, generally 600. The method comprises dispensing a quantity of a medium from a dispensing nozzle and into one or more chambered recess defined about a surface of a carrying mechanism traveling in a machine direction, the dispensing nozzle defining a longitudinal opening extending from a first end to a second end, the first end of the dispensing nozzle receiving the medium and the second end of the dispensing nozzle being angled relative to a perpendicular of the machine direction, the second end of the dispensing nozzle being disposed adjacent to the carrying mechanism, the dispensing nozzle being configured to dispense the quantity of the medium received from the first end through the longitudinal opening and out of the second end into the one or more chambered recess, in step 602.

The method further comprises directing, by at least one wiping material that is arranged to define an angle having a vertex toward the machine direction about a bottom surface of a housing attachable to the dispensing nozzle about the second end thereof, any of the quantity of the medium dispensed out of the second end of the dispensing nozzle, but not directed into the one or more chambered recess, into the one or more chambered recess, the bottom surface of the housing extending away from the dispensing nozzle and adjacent to the carrying mechanism, in step 604.

The apparatus, system, and method disclosed herein resolves issues that may be present in current technical solutions for filling chambered packages because the dispensing apparatus, in particular, provides a focused product stream that minimizes product waste, reduces wear on components of the system and reduces maintenance frequency and associated downtimes. The number of components in the design of the dispensing apparatus also simplifies designs compared with other current technical solutions thereby reducing maintenance and operation costs. Further, the apparatus, system, and method disclosed herein are entirely flexible due to the design and prototyping used. More particularly, rapid prototyping to quickly fabricate a scale model of the dispensing apparatus using computer aided design software in conjunction with a 3D printing or other additive layer manufacturing technology reduces lead time to days versus weeks, increases operational and design flexibility by lending itself to complex geometric designs not easily recreated using conventional machining techniques, increases speed and lowers cost to trial. Therefore, the apparatus, system, and method disclosed herein provide a solution to the problem of filling chambered packages.

Many modifications and other embodiments of the disclosure set forth herein will come to mind to one skilled in the art to which these disclosure pertain having the benefit of the teachings presented in the foregoing descriptions. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for filling a chambered package, the apparatus comprising:

a dispensing nozzle defining a longitudinal opening extending from a first end to a second end, the first end of the dispensing nozzle receiving a medium and the second end of the dispensing nozzle being angled relative to a perpendicular of a machine direction of a carrying mechanism, the second end of the dispensing nozzle being disposed adjacent to the carrying mechanism traveling in the machine direction and having one or more chambered recess defined about a surface of the carrying mechanism, the dispensing nozzle being configured to dispense a quantity of the medium received from the first end through the longitudinal opening and out of the second end into the one or more chambered recess defined about the surface of the carrying mechanism;

a housing attachable to the dispensing nozzle about the second end, the housing defining a bottom surface extending away from the dispensing nozzle and adjacent to the carrying mechanism; and at least one wiping material arranged on the bottom surface of the housing and defining first and second portions that converge towards the machine direction to form an acute angle, the acute angle of the at least one wiping material being configured to direct any of the quantity of the medium dispensed out of the second end of the dispensing nozzle, but not directed into the one or more chambered recess, into the one or more chambered recess.

2. The apparatus of claim 1, wherein the second end of the dispensing nozzle and the bottom surface of the housing are each contoured to match a contour of the surface of the carrying mechanism.

3. The apparatus of claim 1, wherein the carrying mechanism comprises a rotating drum having a cylindrical surface or the carrying mechanism comprises a flatbed conveyor having a planar surface.

4. The apparatus of claim 3, wherein the second end of the dispensing nozzle is disposed between about 10 degrees and about 95 degrees relative to a center of the rotating drum.

5. The apparatus of claim 1, wherein the second end of the dispensing nozzle is angled between about 20 degrees and about 80 degrees relative to the perpendicular of the machine direction of the carrying mechanism.

6. The apparatus of claim 1, wherein the acute angle is between about 15 degrees and about 45 degrees.

7. The apparatus of claim 6, wherein there are three concentrically arranged wiping materials each defining first and second portions that converge towards the machine direction to form an acute angle, each acute angle being about 30 degrees.

8. The apparatus of claim 1, further comprising a tongue extending opposite to the housing and from the second end of the dispensing nozzle, the tongue being contoured to match a contour of the surface of the carrying mechanism.

9. The apparatus of claim 1, wherein the second end of the dispensing nozzle comprises a resilient material configured to directly interact with the carrying mechanism in order to direct the quantity of the medium into the one or more chambered recess defined about the surface of the carrying mechanism.

10. The apparatus of claim 1, wherein at least one groove is formed on the bottom surface of the housing and defines first and second portions that converge towards the machine direction to form the acute angle, the at least one wiping material being arranged within the at least one groove such that the first portion of the at least one wiping material is arranged within the first portion of the at least one groove and the second portion of the at least one wiping material is arranged within the second portion of the at least one groove to form the acute angle.

11. A system for filling a chambered package, the system comprising:

a carrying mechanism travelling in a machine direction and having one or more chambered recess defined about a surface thereof; and a dispensing apparatus comprising:

a dispensing nozzle defining a longitudinal opening extending from a first end to a second end, the first end of the dispensing nozzle receiving a medium and the second end of the dispensing nozzle being angled relative to a perpendicular of the machine direction, the second end of the dispensing nozzle being disposed adjacent to the carrying mechanism, the dispensing nozzle being configured to dispense a quantity of the medium received from the first end through the longitudinal opening and out of the second end into the one or more chambered recess defined about the surface of the carrying mechanism;

a housing attachable to the dispensing nozzle about the second end, the housing defining a bottom surface extending away from the dispensing nozzle and adjacent to the carrying mechanism; and at least one wiping material arranged on the bottom surface of the housing and defining first and second portions that converge towards the machine direction to form an acute angle, the acute angle of the at least one wiping material being configured to direct any of the quantity of the medium dispensed out of the second end of the dispensing nozzle, but not directed into the one or more chambered recess, into the one or more chambered recess.

12. The system of claim 11, wherein the second end of the dispensing nozzle and the bottom surface of the housing are each contoured to match a contour of the surface of the carrying mechanism.

13. The system of claim 11, wherein the carrying mechanism comprises a rotating drum having a cylindrical surface or the carrying mechanism comprises a flatbed conveyor having a planar surface.

14. The system of claim 13, wherein the second end of the dispensing nozzle is disposed between about 10 degrees and about 95 degrees relative to a center of the rotating drum.

15. The system of claim 11, wherein the second end of the dispensing nozzle is angled between about 20 degrees and about 80 degrees relative to the perpendicular of the machine direction of the carrying mechanism.

16. The system of claim 11, wherein the acute angle is between about 15 degrees and about 45 degrees.

17. The system of claim 16, wherein there are three concentrically arranged wiping materials each defining first and second portions that converge towards the machine direction to form an acute angle, each acute angle being about 30 degrees.

18. The system of claim 11, further comprising a tongue extending opposite to the housing and from the second end of the dispensing nozzle, the tongue being contoured to match a contour of the surface of the carrying mechanism.

19. The system of claim 11, wherein the second end of the dispensing nozzle comprises a resilient material configured to directly interact with the carrying mechanism in order to direct the quantity of the medium into the one or more chambered recess defined about the surface of the carrying mechanism.

20. The system of claim 11, further comprising a controller configured to control the dispensing apparatus to dispense the quantity of the medium into the one or more chambered recess defined about the surface of the carrying mechanism when the one or more chambered recess is substantially aligned with the second end of the dispensing nozzle.

* * * * *